United States Patent [19]

Paget

[11] Patent Number: 4,488,088

[45] Date of Patent: Dec. 11, 1984

[54] STARTER CIRCUIT FOR LAMPS WITH HIGH REIGNITION VOLTAGES

[75] Inventor: Fredrick W. Paget, Rockport, Mass.

[73] Assignee: GTE Products Corporation, Stamford, Conn.

[21] Appl. No.: 584,292

[22] Filed: Mar. 1, 1984

Related U.S. Application Data

[63] Continuation-in-part of Ser. No. 385,637, Jun. 7, 1982, abandoned.

[51] Int. Cl.[3] ..... H05B 39/00

[52] U.S. Cl. ..... 315/101; 315/102

[58] Field of Search ..... 315/101, 102

[56] References Cited

U.S. PATENT DOCUMENTS

| | | | |
|---|---|---|---|
| 2,212,427 | 8/1940 | Peters | 315/101 |
| 4,119,887 | 10/1978 | Iyama et al. | 315/101 |
| 4,165,475 | 8/1979 | Pegg et al. | 315/101 |
| 4,181,872 | 1/1980 | Chermin | 315/106 |
| 4,360,762 | 11/1982 | Yamamoto et al. | 315/101 |
| 4,450,383 | 5/1984 | van Vliet et al. | 315/101 |

*Primary Examiner*—Harold Dixon

*Attorney, Agent, or Firm*—Thomas H. Buffton

[57] ABSTRACT

A starter circuit for fluorescent discharge lamps having a high reignition voltage with respect to a peak open circuit voltage wherein a timing and triggering circuit is utilized to delay the application of a the lamp voltage to a starter until the relatively high reignition voltage has passed and a normal lamp operating condition is in effect.

11 Claims, 3 Drawing Figures

STARTER CIRCUIT FOR LAMPS WITH HIGH REIGNITION VOLTAGES

This application is a continuation in part of application Ser. No. 385,637 filed 6-7-82 now abandoned.

TECHNICAL FIELD

This invention relates to fluorescent discharge lamp starting circuitry and more particularly to starting circuitry for fluorescent lamps wherein a lamp voltage having a relatively high peak voltage value is developed.

BACKGROUND ART

In the usual fluorescent discharge lamp starting circuitry it is a common practice to employ an inductive type ballast and a glow lamp type starter with the lamp reignition voltage considerably lower or less than the ionization voltage of the glow lamp. Generally, the fluorescent lamp is activated by the ballasted line voltage and the resultant operational lamp voltage is of a value much less than the voltage necessary to ionize the glow lamp. Thus, the glow lamp is not reignited which would, in turn, undesirably short-circuit and turn off the fluorescent lamp.

Also, there are some fluorescent lamp operating systems which are less expensive than the above-mentined inductive ballast systems or at least could be designed to be more economical than the ordinary inductive ballast system. Specifically, fluorescent lamp starting systems employing a resistor-type ballast have an economic advantage over the ordinary inductor apparatus. Since resistors are less expensive than inductors. An inductor of reduced size which is not required to conduct the full lamp current is another example of enhanced circuitry for operating fluorescent lamps.

Unfortunately, it has been found that ballast circuitry utilizing a ballast resistor tends to produce a lamp voltage having a relatively high peak portion as compared to the ionization voltage of a glow starter. Because the AC line voltage falls below the lamp operating voltage, reverses and builds up in the opposite polarity to the lamp operating voltage, the lamp is not operational for an extended period of time and a substantial decay in ionization wihin the lamp takes place during this non-operational period. Accordingly, a relatively large voltage is required to reignite the lamp and this relatively larger voltage exceeds the ionization voltage of a glow starter. Thus, the glow starter would be activated each cycle which, in turn, would undesirably short-circuit and causes a turn off of the fluorescent lamp. This effect can be countered by reducing lamp length and hence wattage which is generally proportional to length, however, the result is a low wattage lamp of poor efficiency.

In another aspect, a non-linear dielectric element may be utilized to develop a pulse voltage for igniting a fluorescent lamp whereupon a reduction in lamp length or wattage is not required. However, non-linear dielectric elements are characterized by the capability of accepting a charge up to a given value and to then suddenly cease accepting a charge. Thereupon, a very large pulse voltage is developed due to the abrupt discontinuance of current flow in the usual or normal inductive ballast. Accordingly, a lamp voltage is developed which tends to have a peak value much higher than the ionization voltage of a glow starter if one is employed. Thus, the peak lamp voltage reignites the glow starter which, in turn, short-circuits the fluorescent lamp and undesirably discontinues operation of the fluorescent lamp.

One known attempt to remedy the above-mentioned undesirable conditions included a system having a thermal relay heater connecting a ballast to the lamps with the relay contacts coupled to a glow starter shunting the lamp. Although the above-described heater-switch combinations have been and still are widely used in numerous applications, it has been found that the extended period required to cool the heater before resetting of the thermal relay can be effected is most undesirable and severly restrictive of the desired operational capabilities.

OBJECTS AND SUMMARY OF THE INVENTION

An object of the present invention is to provide a fluorescent lamp starting circuit which overcomes the disadvantages of the prior art. Another object of the invention is to provide an enhanced fluorescent lamp starting circuit. Still another object of the invention is to provide an improved fluorescent lamp starting circuit having timing and triggering circuitry prohibiting application of a lamp reignition voltage greater than the ionization voltage to a glow starter. A further object of the invention is to delay the application of a lamp voltage to a glow starter until the lamp voltage is less than the ionization voltage of the glow starter.

These and other objects, advantages and capabilities are achieved in one aspect of the invention by a fluorescent lamp starting circuit having a glow starter coupled to the lamp, a means coupled to the lamp for developing a lamp voltage having a portion greater than and a portion less than the ionizing voltage of the glow starter and a timing and triggering circuit connected in series with the glow starter and shunting the lamp to insure application of lamp voltage less than the ionizing voltage to the glow starter when the lamp is operational.

BEST MODE FOR CARRYING OUT THE INVENTION

For a better understanding of the present invention, together with other and further objects, advantages and capabilities thereof, reference is made to the following disclosure and appended claims in conjunction with the accompanying drawings.

Figure 1:
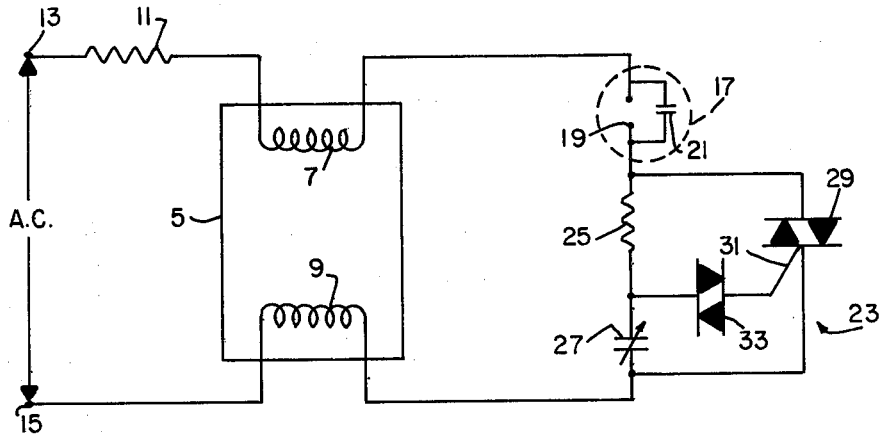
FIG. 1 is a schematic illustration of one form of fluorescent discharge lamp starting circuitry of the invention.

Referring to the drawings, FIG. 1 illustrates a fluorescent lamp starting circuit wherein the reignition voltage of the lamp is at least as great as the ionization voltage of a glow starter. Therein, a fluorescent discharge lamp 5 includes a pair of spaced electrodes 7 and 9 as well as the usual fill gas and phosphor-coated inner wall surface. A resistor ballast 11 couples one of the spaced electrodes 7 to one terminal 13 of an AC potential source. The other spaced electrode 9 is connected to the other terminal 15 of the AC potential source.

A glow starter 17 includes a pair of normally open (N/O) contacts 19 shunted by an impedance 21 such as a capacitor. This glow starter 17 is coupled to the spaced electrode 7. A timing and triggering circuit 23 is coupled to the glow starter 17 and to the other electrode 9 of the discharge lamp 5. Thus, the glow starter 17 and the timing and triggering circuit 23 are series connected and both are shunted across the fluorescent discharge lamp 5.

The timing and triggering circuit 23 includes an integrating circuit in the form of a series connected resistor 25 and capacitor 27 of which either or both may be adjustable in value. A bidirectionally conductive semiconductor triac 29 is shunted across the integrating circuit and includes a gate electrode 31. Also, a voltage responsive bidirectional switching means or diac 33 couples the junction of the resistor 25 and capacitor 27 to the gate electrode 31 of the triac 29.

Figure 2:
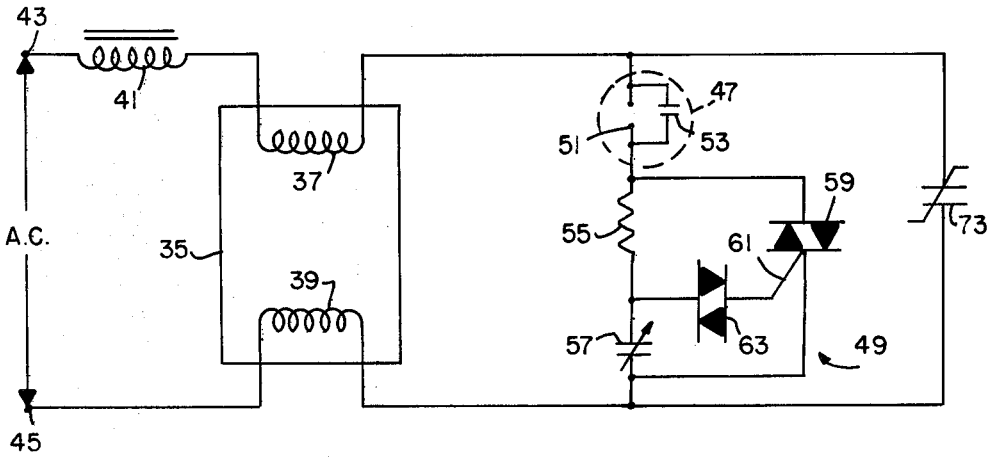
FIG. 2 is an alternate configuration of a fluorescent discharge lamp starting circuit of the invention.

In the alternate embodiment, FIG. 2 illustrates a fluorescent arc discharge lamp 35 having a pair of spaced electrodes 37 and 39 therein as well as the usual fill gas and phosphor-coated inner wall surface. One of the electrodes 37 is coupled by an inductor ballast 41 to one terminal 43 of an AC potential source. The other electrode 39 is connected to the other terminal 45 of the AC potential source.

Shunted across the spaced electrodes 37 and 39 is a series connected glow starter 47 and timing and triggering circuit 49. The glow starter 47 includes a pair of normally open (N/O) contacts 51 shunted by a capacitor 53. The timing and triggering circuit 49 includes a series connected resistor 55 and capacitor 57 either or both of which may be adjustable and together forming an integrating circuit. A triac 59 having a gate electrode 61 is shunted across the series connected resistor 55 and capacitor 57 and a diac 63 couples the junction of the series connected resistor 55 and capacitor 57 to the gate electrode 61 of the triac 59.

Additionally and importantly, a non-linear dielectric element 65, such as a non-linear capacitor, is shunted across the fluorescent discharge lamp 35 and the series-connected glow starter 47 and timing and triggering circuit 49. Thus, the non-linear dielectric element 73 serves, in conjunction with the inductor 41, to develop a lamp voltage having a peak portion equal to or greater than and an operating portion less than the ionizing voltage of the glow starter 47.

As to operation, it should be noted that a problem exists in manufacturing glow starters having a sufficiently narrow ionization range when the differential between the open circuit voltage and the lamp reignition voltage is relatively small. In other words, a line voltage or open circuit voltage must be provided which is sufficiently large enough to effect the desired ionization of the glow starter and cause conductivity of the discharge lamp. On the other hand, the lamp reignition voltage must be significantly less than the ionization voltage of the glow starter or the glow starter will be undesirably rendered conductive while the lamp is operating which, in turn, causes the glow starter to undesirably short-circuit and turn-off the fluorescent lamp.

Figure 3:
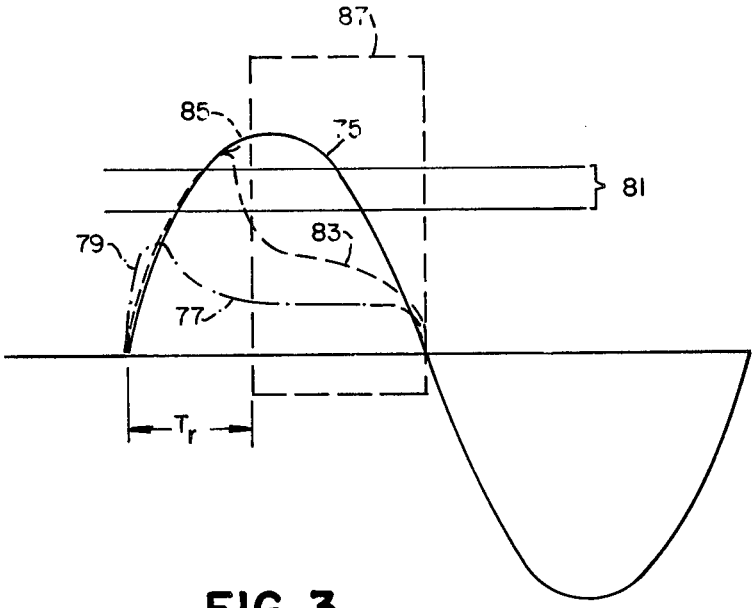
FIG. 3 is a graphic illustration and comparison of the operation of the ordinary and the starting circuitry of the invention.

Referring to the illustrative voltage comparison chart of FIG. 3, a glow starter is manufactured to provide a voltage ionization range 81. Also, an open circuit voltage 75 is provided which has a peak value exceeding the ionization range 81 of a glow starter.

In operation of a normal discharge lamp starting circuit employing an inductor type ballast, the lamp voltage, curve 77, includes a slightly higher reignition voltage 79 which is still much lower in value than the ionizing voltage 81 of the glow starter. Thus, the glow starter is not activated by the lamp reignition voltage and the lamp continues to operate without interruption.

However, it has previously been mentioned that a fluorescent lamp starting circuit employing a means for developing a portion thereof 85 greater than the ionizing voltage 81 of a glow starter and a portion thereof 83 less than the ionizing voltage 81 of the glow starter presents a problem of reignition of the glow starter. In other words, a starting circuit utilizing a resistor type ballast or having a lamp shunted by a non-linear dielectric element tends to provide a lamp potential having a portion 85 of a magnitude greater than the ionizing potential 81 of a glow starter. Unfortunately, such a condition is not tolerable since activation of the glow starter by the reignition voltage would inactivate the fluorescent lamp.

However, the addition of the timing and triggering circuit means provides a delay period $T_1$ and a triac conductive window 87. The timing and triggering circuit serves to disconnect the glow starter from the discharge lamp during the period $T_1$ when the reignition voltage 85 is equal to or exceeds the ionization voltage 81 of the glow starter. Thereafter, the lamp voltage is at an operational level less than the level of the ionizing voltage 81 and the timing and triggering circuit connects the glow starter across the fluorescent lamp. Because of the fact that the lamp voltage 83 is now much less in value than the ionizing voltage level 81 of the glow starter, the glow starter is not activated and has no effect upon the operation of the fluorescent lamp.

More specifically, the capacitor 57 of the integrating circuit portion of the timing and triggering circuit 49 gradually charges until a voltage sufficient to render the diac 63 conductive is developed. Thereupon, the triac 59 is turned on or rendered conductive whereupon the timing and triggering circuit 49 is, in effect, a short circuit. Thus, the glow starter 47 is shunted across the discharge lamp 35. Moreover, the delay or time required to effect this condition, referred to as the delay period $T_1$, is sufficient to allow the lamp voltage 83 to reach a value less than the ionization voltage 81 of the glow starter 47. Accordingly, the glow starter 47 is not ignited and the lamp 35 is not short-circuited and turned off.

Thus, apparatus has been provided for effectively utilizing less expensive components in a fluorescent lamp starting circuit. Moreover, apparatus is provided whereby a reduction in ballast size, weight and cost is possible.

However, it is to be noted that this timing and triggering delay circuitry 49 does not interfer with the starting function of the glow bottle 17 and lamp 5. Initially when the lamp 5 is not energized, the full line voltage 75 is applied to starting circuit and at the end the end of the delay period ($T_1$) the line voltage 75 is still greater than the ionization voltage of the glow starter 17. Thus, the glow starter 17 will ionize and function as a short circuit to shunt the line current through the electrodes 7 and 9 of the discharge lamp 5 causing the electrodes 7 and 9 to heat up to an electron emissive temperature. When the glow starter 17 is rendered non-conductive or opens, due to the normal cooling and opening function of the contacts, the lamp 5 will start due to the application of full line voltage to the previously heated electrodes 7 and 9.

Thus, apparatus has been provided for effectively utilizing less expensive components in a fluorescent lamp starting circuit. The enhanced starting circuit not only provides initial heating of the lamp electrodes and subsequent operation of the discharge lamp but also provides circuitry which delays the availability of a developed potential. In this manner, the glow starter is not activated and operation of the discharge lamp is not adversely affected.

While there has been shown and described what is at present considered the preferred embodiments of the invention, it will be obvious to those skilled in the art that various changes and modifications may be made therein without departing from the invention as defined by the appended claims.

I claim:

1. A fluorescent lamp starting circuit comprising:

a glow starter coupled to said fluorescent lamp;

means coupled to said fluorescent lamp for developing a lamp voltage having a portion thereof greater than and a portion less than the ionizing voltage of said glow starter; and a timing and triggering circuit means connected in series with said glow starter and shunting said fluorescent lamp to provide application of said lamp voltage portion less than said ionizing voltage to said glow starter whereby reignition of said glow starter is prohibited during lamp operation.

2. The fluorescent lamp starting circuit of claim 1 wherein said means coupled to said fluorescent lamp for developing a lamp voltage having a portion thereof greater than and a portion less than the ionizing voltage of said glow starter is in the form of a resistor ballast coupling said fluorescent lamp to an AC potential source.

3. The fluorescent lamp starting circuit of claim 1 wherein said means coupled to said fluorescent lamp for developing a lamp voltage having a portion thereof greater than and a portion thereof less than the ionizing voltage of said glow starter is in the form of a non-linear dielectric element shunting said glow starter and timing and triggering circuit means.

4. The fluorescent lamp starting circuit of claim 1 wherein said means for developing a lamp voltage having a portion thereof greater than and a portion thereof less than the ionizing voltage of said glow starter is in the form of a non-linear capacitor.

5. The fluorescent lamp starting circuit of claim 1 wherein said timing and triggering circuit means includes an integrating circuit in the form of a resistor and capacitor in series connection with said glow starter, a bidirectional semiconductor having a gate electrode and shunting said integrating circuit and a voltage responsive bidirectional switching means coupling the junction of said series connected resistor and capacitor to said gate electrode of said bidirectional semiconductor.

6. The fluorescent lamp starting circuit of claim 5 wherein the impedance of said integrating circuit is adjustable.

7. The fluorescent lamp starting circuit of claim 5 wherein said bidirectional semiconductor of said timing and triggering circuit is in the form of a triac.

8. In a fluorescent lamp starting circuit having a glow starter coupled to a fluorescent lamp, the improvement comprising a means coupled to the lamp for developing a lamp voltage having a voltage portion greater than and a voltage portion less than the ionizing voltage of said glow starter, and a timing and triggering circuit connected in series with said glow starter and shunting said fluorescent lamp, said timing and triggering circuit causing delay in coupling said glow starter in shunt with said fluorescent lamp until said voltage portion of said lamp voltage is less than the ionizing voltage of said glow starter whereby reignition of said glow starter during lamp operation is prohibited.

9. The improvement of claim 8 wherein said means coupled to said lamp for developing a lamp voltage having a portion greater than and a portion less than the ionizing voltage of said glow starter is in the form of a resistor ballast coupling said lamp to an AC potential source.

10. The improvement of claim 8 wherein said means coupled to said lamp for developing a lamp voltage having a portion greater than and a portion less than the ionizing voltage of said glow starter is in the form of a non-linear dielectric element shunting said fluorescent lamp.

11. The improvement of claim 8 wherein said timing and triggering circuit includes an integrating circuit in the form of a capacitor and resistor in series connection with said glow starter, a bidirectional semiconductor having a gate electrode shunting said integrating circuit and a bidirectional switch coupling said integrating circuit to said gate electrode of said bidirectional semiconductor.

* * * * *